US006773289B1

(12) United States Patent
Chen et al.

(10) Patent No.: US 6,773,289 B1
(45) Date of Patent: Aug. 10, 2004

(54) ELECTRICAL PLUG MECHANISM AND ELECTRICAL RECEPTACLE FOR ELECTRICAL CELL

(75) Inventors: Wen-Chi Chen, 12F, No. 19-11, San-Chung Rd., Nan Kang District, Taipei (TW); Ping-Kung Lin, 12F, No. 19-11, San-Chung Rd., Nan Kang District, Taipei (TW); Greg Liang, 12F, No. 19-11, San-Chung Rd., Nan Kang District, Taipei (TW)

(73) Assignees: Allis Electric Co., Ltd., Taipei (TW); Wen-Chi Chen, Taipei (TW); Ping-Kung Lin, Taipei (TW); Greg Liang, Taipei (TW)

( * ) Notice: Subject to any disclaimer, the term of this patent is extended or adjusted under 35 U.S.C. 154(b) by 0 days.

(21) Appl. No.: 10/720,238

(22) Filed: Nov. 25, 2003

(51) Int. Cl.[7] ..... H01R 4/50
(52) U.S. Cl. ..... 439/332; 439/159
(58) Field of Search ..... 439/660, 332, 439/333, 327, 304, 346, 159, 152, 160

(56) References Cited

U.S. PATENT DOCUMENTS 4,737,124 A * 4/1988 Ezure et al. ..... 439/610
4,789,759 A * 12/1988 Jones ..... 174/65 SS
4,802,864 A * 2/1989 Michaels et al. ..... 439/457
4,820,176 A * 4/1989 Niikura ..... 439/152
5,118,301 A * 6/1992 Bentivolio ..... 439/188
5,171,291 A * 12/1992 d'Alayer de Costemore d'Arc ..... 439/152
5,429,516 A * 7/1995 d'Alayer de Costemore d'Arc ..... 439/159
5,480,313 A * 1/1996 d'Alayer de Costemore d'Arc ..... 439/159
5,655,916 A * 8/1997 Hayashi ..... 439/155
5,921,798 A * 7/1999 Ursich ..... 439/346
6,206,714 B1 * 3/2001 Bernardini ..... 439/335

* cited by examiner

*Primary Examiner*—P. Austin Bradley
*Assistant Examiner*—Phuongchi Nguyen
(74) *Attorney, Agent, or Firm*—Rosenberg, Klein & Lee

(57) ABSTRACT

A electrical plug mechanism and electrical receptacle is described. The present invention has an electrical plug, a plug guard and an electrical receptacle. The electrical plug has an end surface, and a plurality of protruding plates and a plurality of holes are defined on the end surface. A plurality of shafts correspond to and travel through the holes of the end surface. The plug guard has hollow protrusions corresponding to the protruding plates of the electrical plug, grooves corresponding to the hollow protrusions and holes corresponding to the shafts. The electrical receptacle has holders corresponding to the protruding plates.

10 Claims, 9 Drawing Sheets

ELECTRICAL PLUG MECHANISM AND ELECTRICAL RECEPTACLE FOR ELECTRICAL CELL

BACKGROUND OF THE INVENTION

1. Field of the Invention

The present invention relates to an electrical plug mechanism and an electrical receptacle, and in particular to an electrical plug and an electrical receptacle for use in at least two electrical cells in series or in parallel which can avoid electrical shock and generate electrical current with more amperes.

2. Description of Related Art

When two electrical cells, such as, for example, two electrical cells of an uninterrupted power system (UPS), are in series or in parallel, a user may receive an electrical shock because an electrical plug and electrical receptacle of the electrical cell are electrically connected and the user does not know which part of the electrical plug and the electrical receptacle carry electrical current. Thus, a technical solution to the situation is necessary.

To overcome the shortcomings above, as shown in FIGS. 1 and 2, a conventional electrical plug 4 has a plurality of pins 41 which are respectively enclosed by tubes 42, and a gap 43 is positioned between the pins 41 and the tubes 42. An isolation end 411 is positioned in each of the pins 41, and each of the pins 41 is enclosed by an arch-shaped spring 412.

Referring to FIGS. 1 and 2, a conventional electrical receptacle 3 has a housing 31, and a plurality of holes 33 are defined in the housing 31 and correspond to the pins 41 of the conventional electrical plug 4. Further, a gap 34 is positioned between the housing 31 and each of holes 33 and corresponds to each of the tubes 42 of the conventional electrical plug 4. Thus, when the conventional electrical plug 4 is inserted in the conventional electrical receptacle 3, the arch-shaped spring 412 is electrically connected with the inner surface (not shown) of each of the holes 33. In addition, the conventional electrical receptacle 3 also has a recess 321 of an extension 32, which is sized to receive the conventional electrical plug 4. As described above, the conventional electrical receptacle 3 and the conventional electrical plug 4 are electrically connected and isolated from the environment so the user is not likely to receive an electrical shock.

However, the pins 41 of the conventional electrical plug 4 are electrically connected with the holes 33 of the conventional electrical receptacle 3 via the arch-shaped spring 412. Contact between the pins 41 and the arch-shaped spring 412 thus results in high resistance and high thermal temperature, known as "the second contact". In addition, the pins 41 are isolated from the environment by the tubes 42, but the design of the electrical equipment must conform to safety standards for electrical equipment that prevent the user's fingers from penetrating into the holes 33 and receiving an electrical shock, so the diameter of tubes 42 cannot be extended and maximum electrical current of the pins 41 cannot exceed 25 amperes. In this regard, the conventional electrical receptacle 3 and the conventional electrical plug 4 are only suitable for an electrical current less than 25 amperes.

Thus, there is need to develop an electrical plug mechanism and an electrical receptacle for use in at least two electrical cells.

SUMMARY OF THE DISCLOSURE

It is an object of the present invention to provide an electrical plug mechanism and electrical receptacle to avoid electrical shock.

It is an object of the present invention to provide an electrical plug mechanism and electrical receptacle that has low resistance and thermal temperature and carries an electrical current greater than 25 amperes.

In order to accomplish the object of the present invention, the present invention provides an electrical plug mechanism and an electrical receptacle. The present invention includes an electrical plug, a plug guard and an electrical receptacle. The electrical plug has an end surface, and a plurality of protruding plates and a plurality of holes defined on the end surface. A plurality of shafts correspond to and travel through the holes of the end surface. The plug guard has hollow protrusions corresponding to the protruding plates of the electrical plug, grooves corresponding to the hollow protrusions and holes corresponding to the shafts. The electrical receptacle has holders corresponding to the protruding plates.

BRIEF DESCRIPTION OF DRAWINGS

The present invention can be fully understood from the following detailed description and preferred embodiment with reference to the accompanying drawings, in which.

DETAILED DESCRIPTION OF THE PREFERRED EMBODIMENTS

Figure 1:
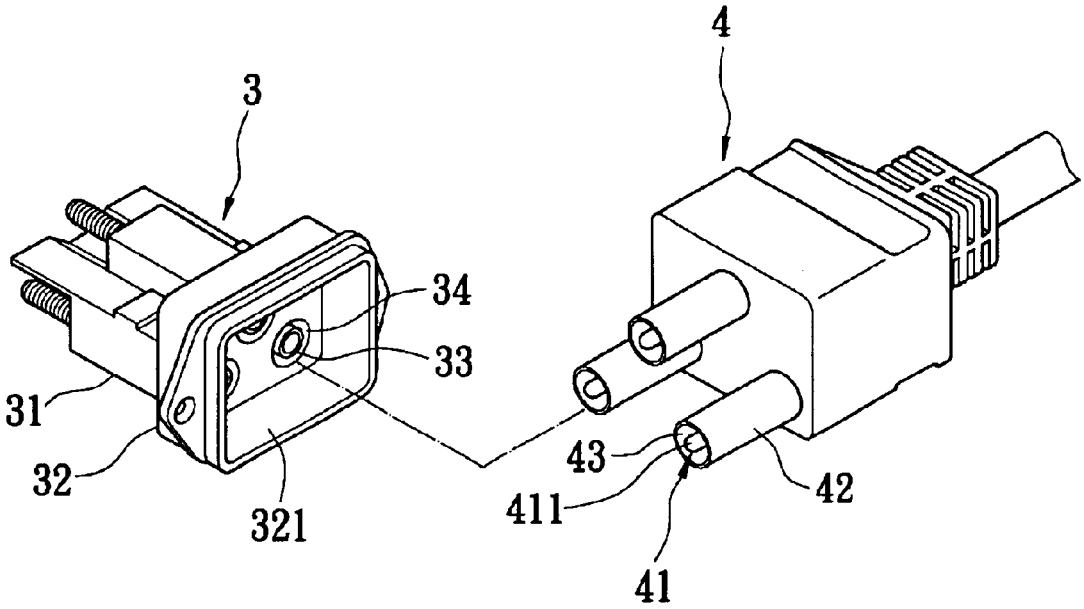
FIG. 1 PRIOR ART
FIG. 1 is a perspective view of a mechanism of a conventional electrical plug and electrical receptacle.
Figure 2:
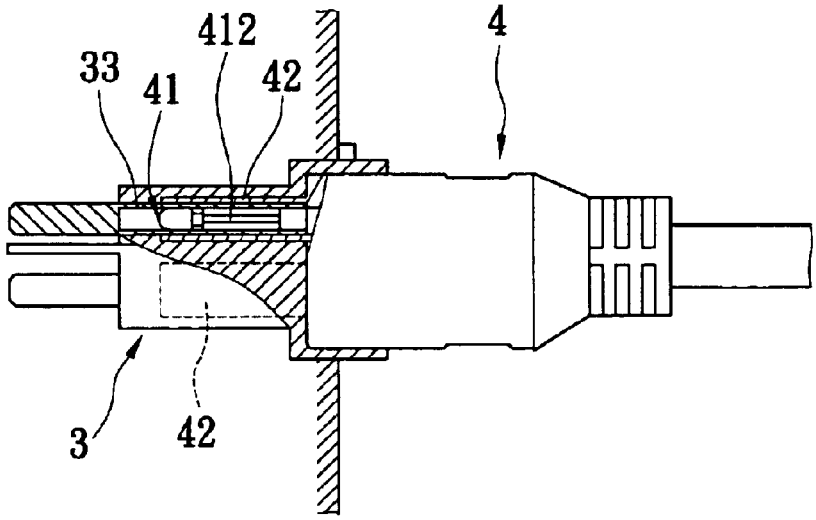
FIG. 2 PRIOR ART
FIG. 2 is a cross-sectional view of the mechanism of the conventional electrical plug and electrical receptacle.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Referring to FIGS. 3–10, an electrical plug mechanism and an electrical receptacle in accordance with the present invention is shown. In one embodiment of the present invention, the electrical plug 22 has a protrusion portion 22*a* and a receptacle portion 22*b*. The electrical plug 20 has a main body 201 and a mounting portion 208 that are removably coupled. When the main body 201 and the mounting portion 208 are assembled, an end surface 2083 of the mounting portion 208 is visible.

Assembly of the electrical plug is described as follows. A plurality of protruding plates 206, shafts 211 and resilient members 210 are positioned at the mounting portion 208, and electrical cable 23 positioned within the main body 201 is electrically connected to the protruding plates 206. Then, the mounting portion 208 is fixedly positioned on the main body 201 by a plurality of screws 212 so that assembly of the electrical plug 20 is complete. The plug guard 21 corresponds to the protruding plates 206 of the mounting portion 208, and the plug guard 21 is axially connected to the end surface 2083 of the mounting portion 208 by screw 21*e*, thereby resulting in the electrical plug 20 with the plug guard 21.

The electrical plug of the present invention comprises main body 201 and mounting portion 208. The mounting portion 208 is cylindrical-shaped and an end surface 2083 thereof is enlarged. A plurality of protuberances 2082 are positioned near the end surface 2083, and three grooves 2081 are positioned away from the end surface 2083. The protruding plates 206 extends through the end surface 2083 of the mounting portion 208 and are fixedly positioned on the mounting portion 208 by screws 207 and mounting washers 205.

Figure 3:
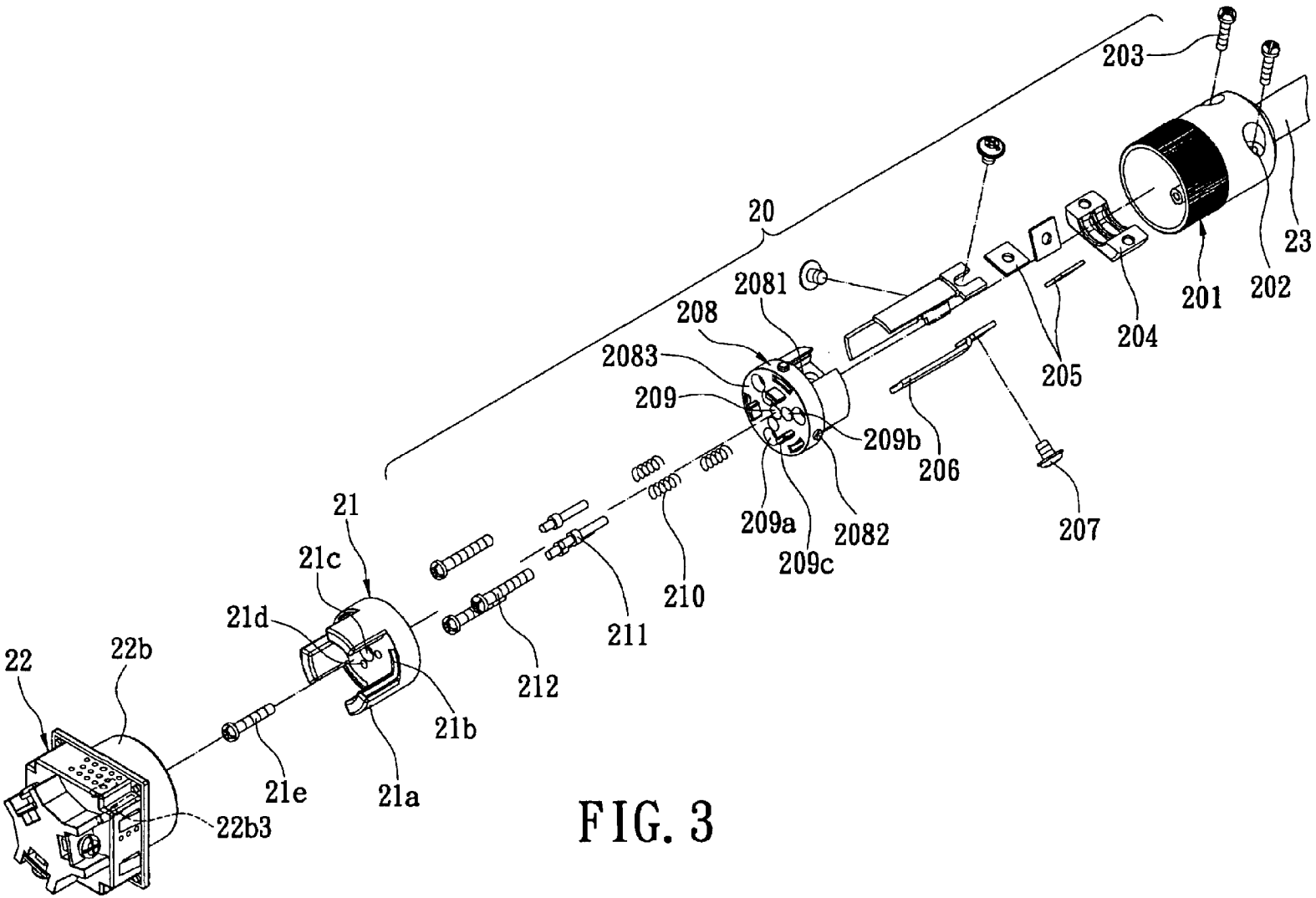
FIG. 3 is an exploded view of an electrical plug and an electrical receptacle of the present invention.
Figure 4:
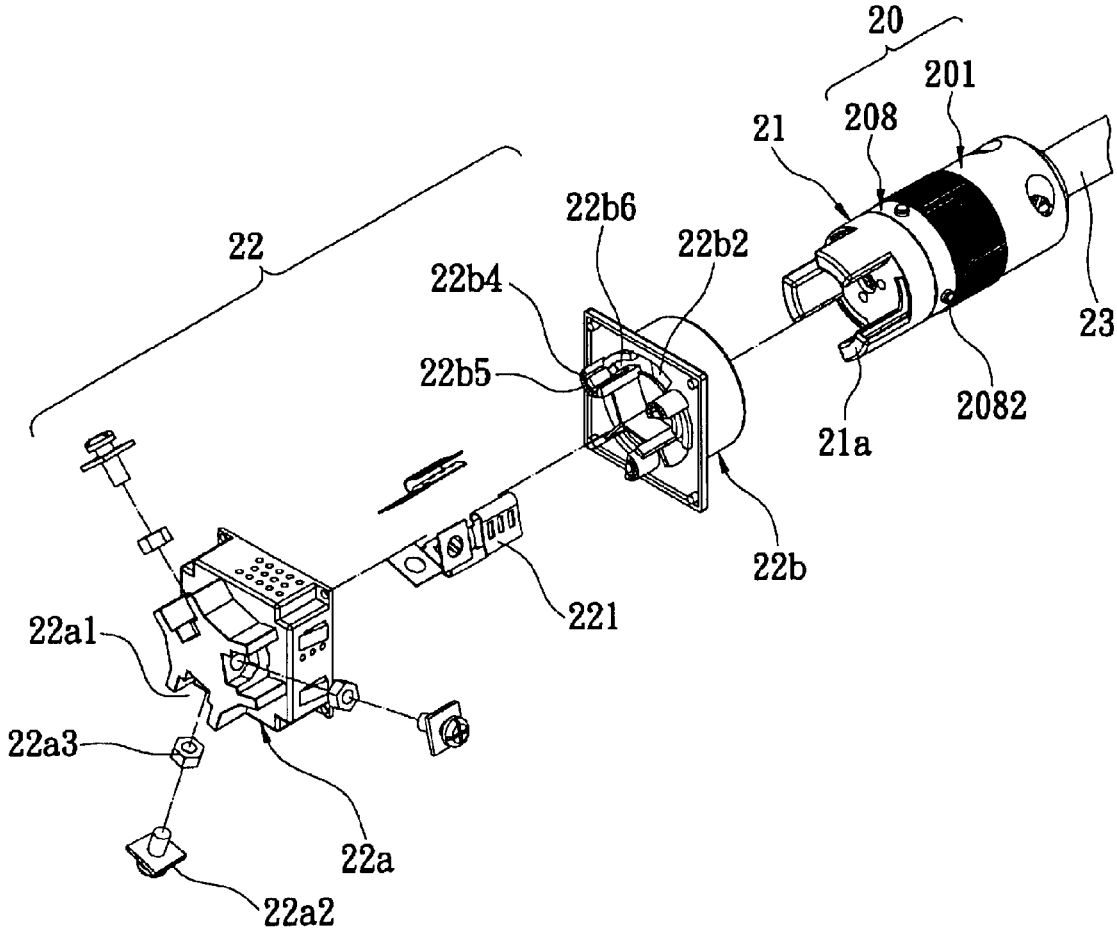
FIG. 4 is another exploded view of an electrical plug and an electrical receptacle of the present invention.

Further referring to FIG. 3, the end surface 2083 of the mounting portion 208 has a hole 209, a plurality of screw holes 209*a* and a plurality of holes 209*b*. The hole 209 is positioned at the center of the end surface 2083, and the screw holes 209*a* are positioned near the periphery of the end surface 2083. The holes 209*b* are positioned between the screw holes 209*a* and the hole 209. In addition, three stubs 209*c* are defined on the end surface 2083 and axially extend from the end surface 2083 so that the stubs 209*c* can be inserted in the corresponding annular grooves (not shown) of the plug guard 21.

Figure 5:
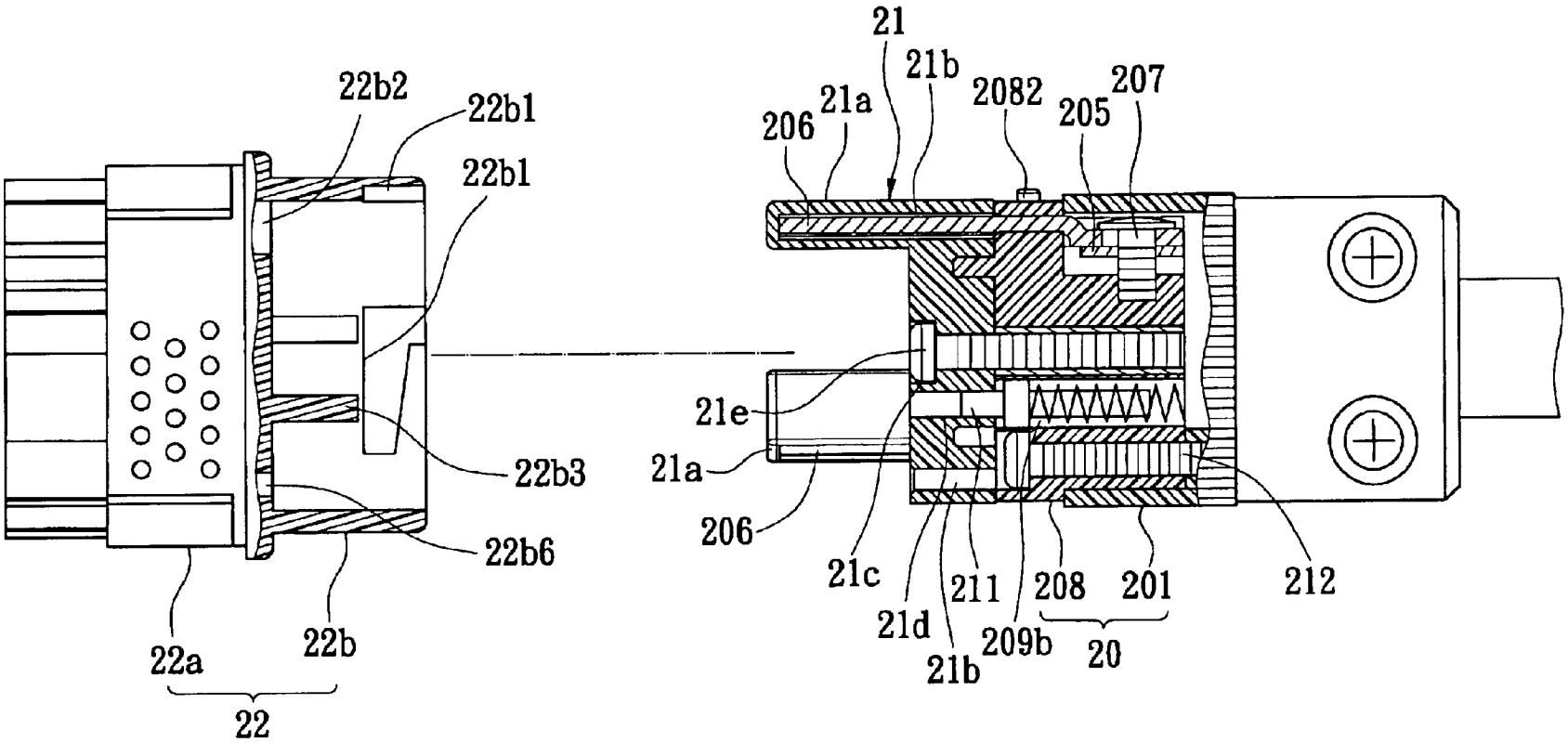
FIG. 5 is a cross-sectional view of the electrical plug and the electrical receptacle of FIG. 4 before they are combined.
Figure 6:
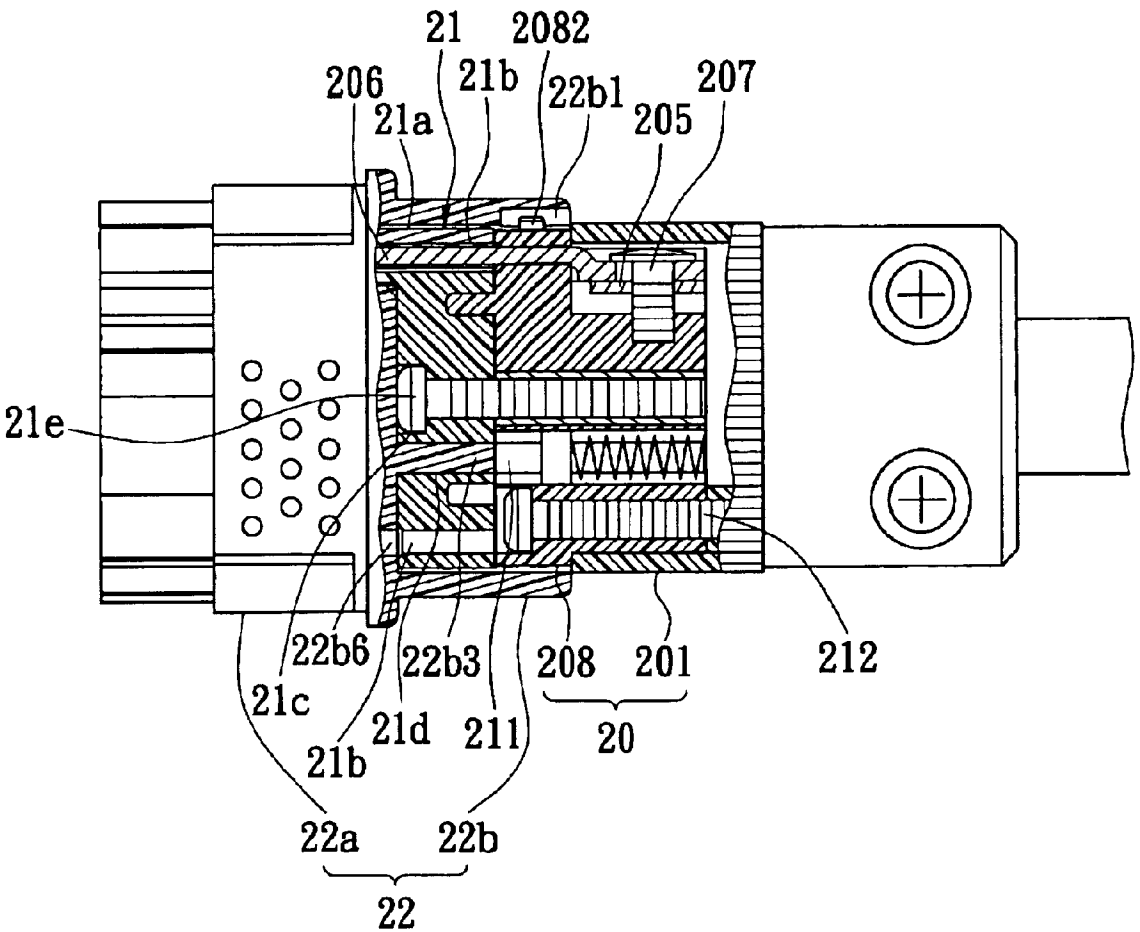
FIG. 6 is a cross-sectional view of the electrical plug and the electrical receptacle of FIG. 4 before they are separate.
Figure 7:
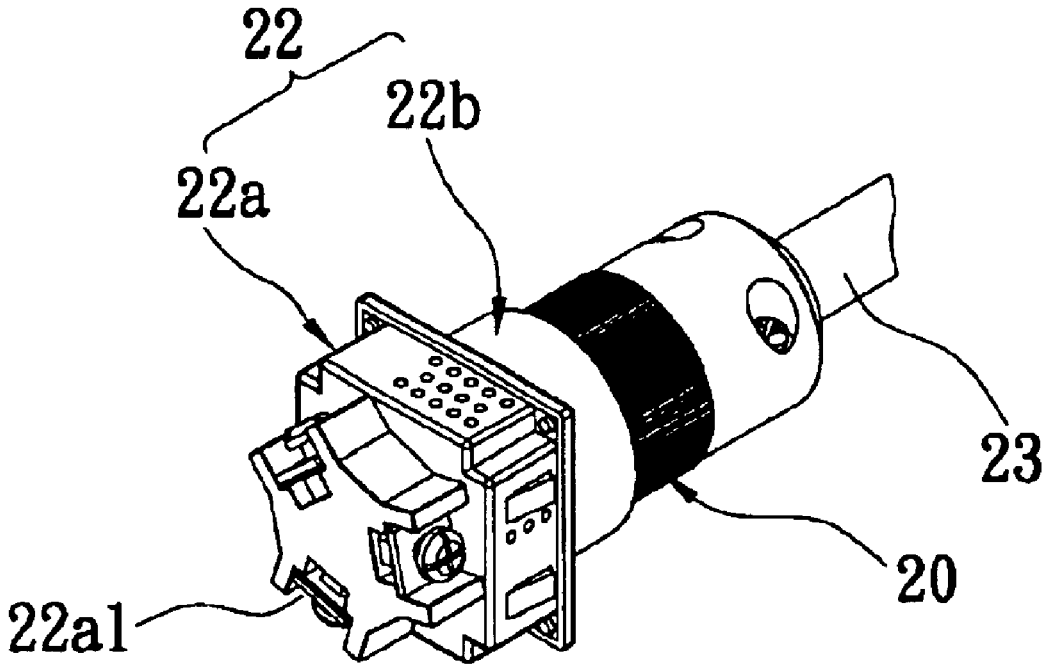
FIG. 7 is a perspective view of the mechanism of the electrical plug and the electrical receptacle in accordance with the present invention.
Figure 8:
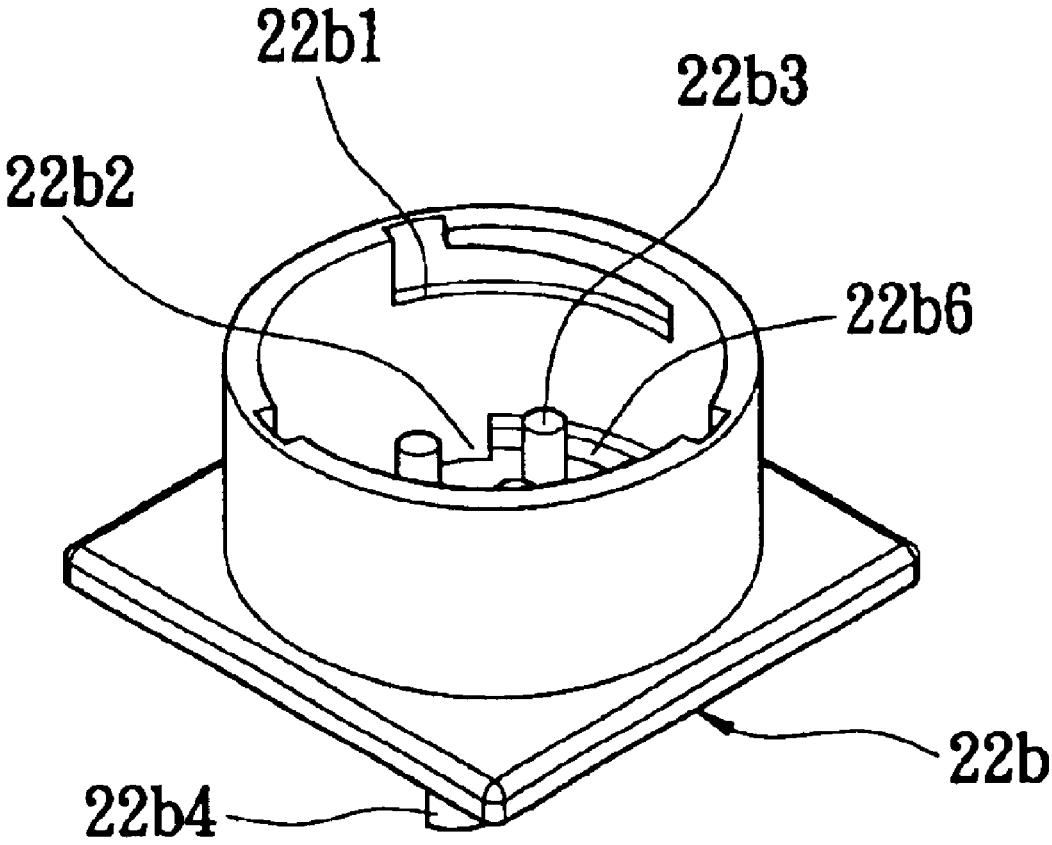
FIG. 8 is a perspective view of the electrical plug in accordance with the present invention.

Further, the resilient member 210 are respectively sized to receive the shafts 211. Resilient member 210 and the shafts 211 are inserted in the holes 209*b*, as shown in FIG. 5. In this regard, the shafts 211 can move back and forth due to resilience of the resilient member 210.

The main body 201 is cylindrical and hollow, and one end of the main body 201 is connected with the electrical cable 23 and has a plurality of screw holes 202 therein. A mounting block 204 is fixedly positioned within the main body 201 by threading a plurality of screws 203 through the screw holes 202. In this regard, if the screws 203 are threaded through the screw holes 202 by more turns, the electrical cable 23 will be fixed much more tightly. Further, a plurality of electrical wires with smaller diameter (not shown) of the electrical cable 23 are fixed to the grooves 2081 of the mounting portion 208 by the screws 207.

Finally, the mounting portion 208 is fixedly fitted to the main body 201 because the screws 212 thread through a threaded protrusion (not shown) of the main body 201. Thus, the assembly of the electrical plug 20 is complete.

The plug guard 21 is circular-shaped and has a hole 21*c*, a plurality of holes 21*d* and a plurality of hollow protrusions 21*a*. The hole 21*c* and the holes 21*d* of the plug guard 21 respectively correspond to the hole 209 and the holes 209*b* of the mounting portion 208. Each of the hollow protrusions 21*a* corresponds to and is sized to receive each of the protruding plates 206. The plug guard 21 is axially connected to the end surface 2083 of the mounting portion 208, and each of the hollow protrusions 21*a* is sized to receive each of the protruding plates 206 because the screw 21*e* threads through the hole 209, which is threaded. Further, each shaft 211 extends through and travels within each hole 21*d* of the plug guard 21 so that the electrical plug 20 and the plug guard 21 cannot axially be rotated with respect to each other.

Further, a groove 21*b* is positioned in each of the hollow protrusions 21*a* and is L-shaped so that each protruding plate 206 can be removed from each hollow protrusion 21*a*.

The electrical receptacle 22 has a plurality of holders 221 and the protrusion portion 22*a* and the receptacle portion 22*b*.

The protrusion portion 22*a* is box-shaped and has a plurality of fixing portions 22*a*1, a plurality of pins 22*a*4 and a plurality of U-shaped grooves 22*a*5. The pins 22*a*4 and the U-shaped grooves 22*a*5 extend axially from the protrusion portion 22*a*. A planar portion 221*b* of the holder 221 (see FIG. 9) passes through the protrusion portion 22*a* and moves into the fixing portion 22*a*1 so that the holder 221 can be fixed to the protrusion portion 22*a* by bolts 22*a*2 and screws 22*a*3.

The receptacle portion 22*b* includes a plurality of circular apertures 22*b*2 and a plurality of holder grooves 22*b*6, and each of the circular apertures 22*b*2 is in communication with each of the holder grooves 22*b*6. The receptacle portion 22*b* also has a plurality pins 22*b*4 and a plurality of U-shaped grooves 22*b*5. The receptacle portion 22*b* corresponds to the protrusion portion 22*a*, so the pins 22*b*4 correspond to the pins 22*a*4. The U-shaped grooves 22*a*5 are in communication with the U-shaped grooves 22*b*5. The holder 221 is positioned within the electrical plug 22 by the holding portion 221*a* so the holder 221 can be covered and prevents the user from being got electrical shock.

The receptacle portion 22*b* is adapted to receive the electrical plug 20 and has guide grooves 22*b*1 in the receptacle portion 22*b*. Each of the guide grooves 22*b*1 is adapted to receive each of the protuberances 2082 of the plug guard 21. Thus, the electrical plug 20 cannot be unplugged at any angle with respect to the electrical plug 22. A plurality of pins 22*b*3 of the receptacle portion 22*b* correspond to the shafts 211 so that the pins 22*b*3 can extend through the holes 21*d* of the plug guard 21 and pushes the shafts 211 back and forth due to resilience of the resilient members 210. Thus, the plug guard 21 can be axially rotated with respect to the electrical plug 20.

Figure 9:
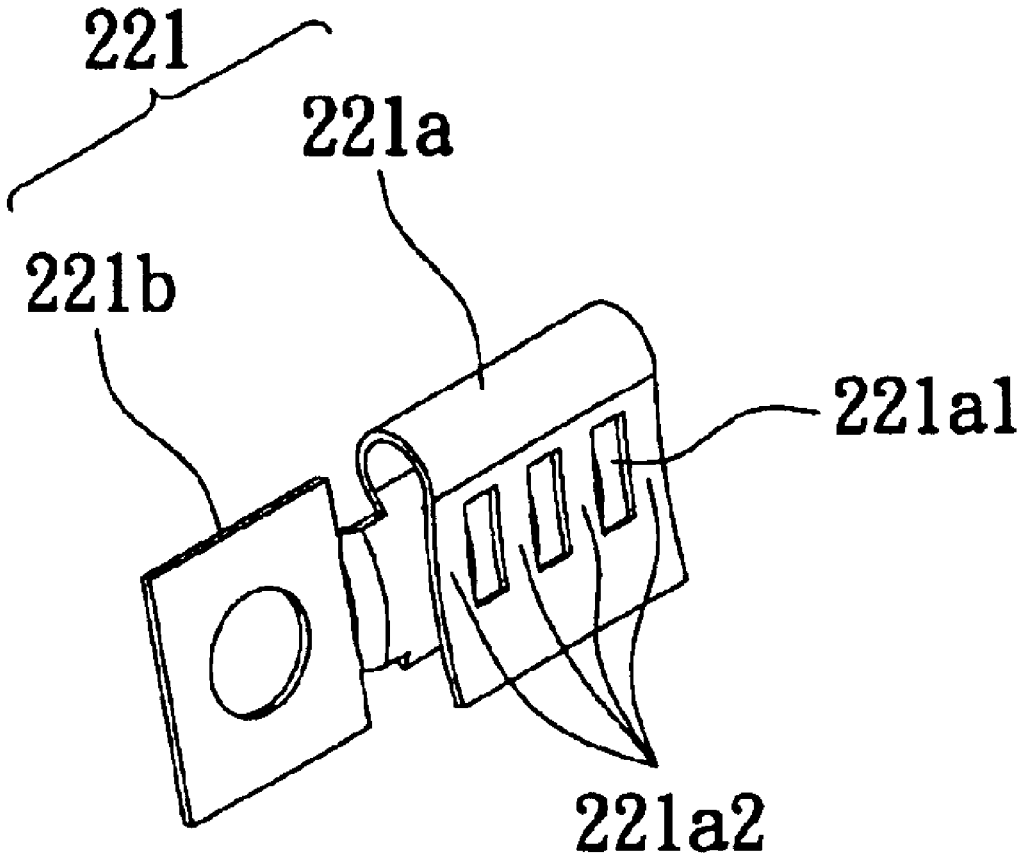
FIG. 9 is an enlarged perspective view of a holder of the present invention.
Figure 10:
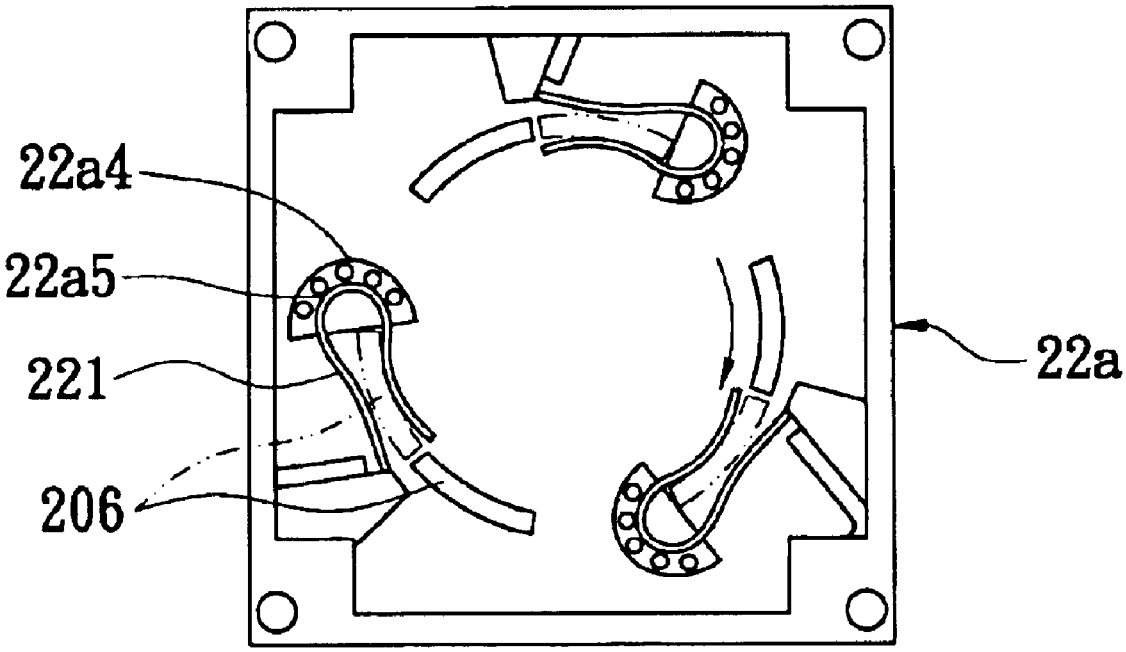
FIG. 10 is a plan elevational view of the electrical plug in accordance with the present invention.

As shown in FIG. 9, the holder 221 has the holding portion 221*a* and the planar portion 221*b*. The holding portion 221*a* is U-shaped, and the planar portion 221*b* is integrally formed with the holding portion 221*a*. In addition, the holding portion 221*a* of the holder 221 has two curved and symmetrical holding planes that are adapted to receive the protruding plates 206. Contact between the holder 221 and the protruding plates 206 results in lower resistance and lower thermal temperature, known as "the first contact".

Further, the holder 221 has a plurality of grooves 221*a*1 and a plurality of conductive beams 221*a*2 so that the holder 221 is in electrical contact with the protruding plates 206 and area of contact between the holder 221 and the protruding plates 206 increases. Thus, the present invention can carry electrical current greater than 25 amperes. In addition, according to the present invention, contact area between the holder 221 and the protruding plates 206 can be further increased so that the present invention can carry electrical current with significantly more than 25 amperes.

The holder 221 is positioned by the pins 22*a*4 and the pins 22*b*4 that corresponds to the holder grooves 22*b*6. The circular apertures 22*b*2 of the receptacle portion 22*b* correspond to the hollow protrusions 21*a* of the plug guard 21. Thus, when the electrical plug 20 is inserted in the electrical receptacle 22, the hollow protrusions 21*a* of the plug guard 21 are adapted to fit to the circular apertures 22*b*2 and the protuberances 2082 are adapted to fit to the guide grooves

22*b*1. Further, the shafts 211 of the electrical plug 20 can be pushed by the pins 22*b*3 of the electrical receptacle 22. The electrical plug 20 can be freely rotated with respect to the electrical receptacle 22.

After the electrical plug 20 is rotated, the protuberances 2082 will further move into the end of the guide grooves 22*b*1, and the protruding plates 206 will move to the grooves 21*b* of the hollow protrusions 21*a*. In a word, when the electrical plug 20 is not inserted in the electrical receptacle 22 yet, the protruding plates 206 will not move out of the hollow protrusions 21*a*. As long as the electrical plug 20 is already inserted in the electrical receptacle 22, the protruding plates 206 appear. In this regard, the electrical plug is electrically connected to the electrical receptacle so that the present invention prevents user from being electrically shocked.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. A an electrical plug mechanism and an electrical receptacle for use in an electrical cell, comprising:

an electrical plug, having protruding plates, a plurality of holes, and shafts corresponding to and traveling through the holes;

a plug guard, axially connected to the end surface of the electrical plug and having hollow protrusions corresponding to the protruding plates and grooves, and having holes corresponding to the shafts, the hollow protrusions adapted to receive the protruding plates, and the shafts inserted in the holes; and an electrical receptacle, having holders corresponding to the protruding plates and pins corresponding to the shafts;

whereby the electrical plug is inserted in the electrical receptacle to move the shafts away from the holes of the plug guard, and the plug guard and the electrical plug are axially rotated around each other to connect electrically the protruding plates to the holders.

2. The mechanism as claimed in claim 1, wherein a plurality of protuberances is positioned on the electrical plug and three grooves are positioned on the electrical receptacle, whereby the protuberances of the electrical plug are adapted to fit to the grooves of the electrical receptacle.

3. The mechanism as claimed in claim 1, wherein the electrical plug further comprises a mounting portion including a plurality of holes and shafts positioned in the holes.

4. The mechanism as claimed in claim 3, wherein a plurality of protuberances are positioned near the mounting portion and the protuberances correspond to the electrical receptacle, whereby guide grooves of the receptacle portion are adapted to receive the protuberances of the plug guard.

5. The mechanism as claimed in claim 1, wherein the holder has a U-shaped holding portion and the planar portion integrally formed with the holding portion, and the holding portion has two curved and symmetrical holding planes adapted to receive the protruding plates.

6. The mechanism as claimed in claim 5, wherein a plurality of grooves and a plurality of conductive beams are defined on the holder to place the holder in electrical contact with the protruding plates.

7. The mechanism as claimed in claim 1, wherein the electrical plug further comprises a protrusion portion and a receptacle portion, and the protrusion portion is connected to an electrical cable and the receptacle portion has pins corresponding to the shafts and grooves adapted to receive the protuberances of the electrical plug, whereby holders are positioned between the protrusion portion and the receptacle portion and the electrical plug is electrically connected to the protruding plates.

8. The mechanism as claimed in claim 7, wherein the protrusion portion is electrically connected to the electrical cable and has a plurality of pins, whereby the holders pass through the protrusion portion.

9. The mechanism as claimed in claim 7, wherein the receptacle portion includes a plurality of circular apertures and a plurality of holder grooves, and the hollow protrusions of the plug guard correspond to the circular apertures, whereby the hollow protrusions are inserted in the circular apertures after the electrical plug is inserted in the electrical receptacle.

10. The mechanism as claimed in claim 7, wherein the receptacle portion is adapted to receive the electrical plug, and the guide grooves are defined on the receptacle portion and a plurality of pins extend from the receptacle portion.

* * * * *